US006131322A

United States Patent [19]

Hjaltason

[11] Patent Number: 6,131,322

[45] **Date of Patent: *Oct. 17, 2000**

[54] SIGN PLATE FOR ILLUMINATED SIGN

[75] Inventor: Thorgeir Daniel Hjaltason, Akureyri, Iceland

[73] Assignee: Artlite Limited, London, United Kingdom

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/963,002

[22] Filed: Nov. 3, 1997

Related U.S. Application Data

[63] Continuation of application No. 08/439,998, May 12, 1995, Pat. No. 5,682,697, which is a continuation of application No. 08/156,352, Nov. 22, 1993, Pat. No. 5,414,947, which is a continuation of application No. 07/770,996, Oct. 1, 1991, abandoned.

[51] Int. Cl.[7] ..... G09F 19/00

[52] U.S. Cl. ..... 40/615; 40/584

[58] Field of Search ..... 40/580, 582, 583, 40/584, 541, 542, 564, 615

[56] References Cited

U.S. PATENT DOCUMENTS

| | | |
|---|---|---|
| 478,204 | 7/1892 | McGimsey . |
| 1,725,206 | 8/1929 | Peterson . |
| 1,786,155 | 12/1930 | Farrell . |
| 1,805,798 | 5/1931 | Bedrossyan . |
| 1,887,523 | 11/1932 | Schenkel . |
| 1,975,690 | 10/1934 | Harrington et al. . |
| 2,071,239 | 2/1937 | Spencer et al. . |
| 2,107,860 | 2/1938 | Gilbert . |
| 2,213,868 | 9/1940 | Lucian . |
| 2,262,930 | 11/1941 | Gasper . |
| 2,374,323 | 4/1945 | Bihr . |
| 2,594,903 | 4/1952 | Freedman et al. . |
| 2,689,917 | 9/1954 | Switzer . |
| 2,707,346 | 5/1955 | Fuller, Jr. . |
| 2,810,225 | 10/1957 | Hardesty . |
| 2,886,911 | 5/1959 | Hardesty . |
| 3,131,670 | 5/1964 | Hardesty . |
| 3,270,201 | 8/1966 | Hardesty . |
| 3,583,298 | 6/1971 | Van Swearingen . |
| 3,771,245 | 11/1973 | Mabrey et al. . |
| 3,978,599 | 9/1976 | Berger . |
| 4,106,859 | 8/1978 | Doriguzzi et al. . |
| 4,424,449 | 1/1984 | O'Brill . |
| 4,435,743 | 3/1984 | Plumly . |
| 4,507,888 | 4/1985 | Robinson et al. . |
| 4,583,766 | 4/1986 | Wessel . |
| 4,891,896 | 1/1990 | Boren . |
| 5,009,019 | 4/1991 | Erlendsson et al. . |
| 5,273,796 | 12/1993 | Elbing et al. . |
| 5,414,947 | 5/1995 | Hjaltason . |
| 5,682,697 | 11/1997 | Hjaltson . |
| 5,829,177 | 11/1998 | Hjaltason . |

FOREIGN PATENT DOCUMENTS

| | | |
|---|---|---|
| 3715127 | 9/1988 | Germany . |
| 496482 | 11/1938 | United Kingdom . |
| 496482 | 12/1938 | United Kingdom . |

*Primary Examiner*—Milton Nelson, Jr.
*Attorney, Agent, or Firm*—Brinks Hofer Gilson & Lione

[57] ABSTRACT

A sign plate for an illuminated sign having a light source includes an opaque reflective layer on its face that receives light from the light source. The opaque reflective layer is broken by zones corresponding to a configuration of text, figures, and/or art design to be communicated to a viewer. The zones are covered with a light diffusion layer on the side of the light source, and the surface of the sign plate facing the viewer and opposite the light source includes a layer of reflective material in a corresponding configuration that is in general register with the configuration defined by the zones and covered by the light diffusion layer on the side of the light source.

60 Claims, 3 Drawing Sheets

SIGN PLATE FOR ILLUMINATED SIGN

This application is a continuation of application Ser. No. 08/439,998, filed May 12, 1995, now U.S. Pat. No. 5,682, 697, which was a continuation of application Ser. No. 08/156,352, filed Nov. 22, 1993, now U.S. Pat. No. 5,414, 947, which was a continuation of application Ser. No. 07/770,996, filed Oct. 1, 1991, now abandoned.

BACKGROUND OF THE INVENTION

1. Field of the Invention

This invention relates to a sign plate for an illuminated sign. The sign plate includes a base plate made of light transmitting material with an opaque reflective layer or coating on at least one side of the light transmitting base plate. The integrity of the opaque reflective layer is broken by zones that form a configuration defining a message, art display, or other matter or intelligence communicated when the sign plate is illuminated. A corresponding configuration, but of light reflective material, is provided on the opposite side of the base plate. The sign plate also includes a light diffusion layer that receives and disperses light from the light source. By a particular arrangement of opaque surfaces and reflective surfaces relative to the light diffusion layer and an adjacent light source, electromagnetic radiation in the form of visible light from the light source is controlled to provide an aura that enhances formed outlines or contours of light around the communicated matter of the sign plate.

2. Description of the Related Art

An illuminated sign of this nature is disclosed in U.S. Pat. No. 5,009,019. In that invention an aura is created around an outline of the configuration being communicated by the sign. This aura is achieved by fluorescent material totally covering broken zones in an opaque layer on the sign plate. The fluorescent material is cut in the form of the configuration from a sheet of fluorescent plastic and is applied on the surface of the light transmitting base plate opposite the surface having the opaque layer or coating that is broken into the zones, and these zones correspond to the desired configuration to be communicated. The configuration made from the fluorescent plastic may be cut from a sheet by, for example, a router. This configuration when applied to the face of the base projects away from the base surface. The projection is on the front of the sign plate in that invention, i.e., the face of the sign plate that faces the viewer when the sign plate is in use.

The light source is directed toward the rear of the sign plate, i.e., the face of the sign plate opposite the viewer. In that invention, the most effective results are achieved when the light source is ultraviolet light, and the light rays pass forward through the openings of the broken zones of the opaque layer through the base plate and then into the fluorescent material, activating the fluorescent material.

A layer of opaque reflective material is placed on the front surface of the projecting fluorescent material that faces the viewer. This opaque reflective material is preferably of a smaller dimension than the broken zones, and so light emits around the edges only of the light reflective material, producing an outline or contour of the configuration being communicated. Accordingly, part of the light rays from the activated fluorescent material pass through the exposed side edges of the fluorescent material, while other rays are reflected off the light reflective layer back through the fluorescent material thence through the light transmitting base plate to its rear face to strike the front of the opaque reflective layer on the rear of the base plate. From there, the rays are reflected forwardly toward the viewer. These reflected rays create the aura around the outline.

For a viewer facing the sign plate, the effect achieved in that construction is that of glowing outlines and aura around the configuration of the matter being communicated, such as text or figures or art work.

The invention of the '019 patent is a vast improvement over the prior art known when its application was filed. For example, Danish Patent Application No. 4729/87, published under the Patent Cooperation Treaty in Publication WO-A-89,02637 on Mar. 23, 1989, discloses a transparent or ultraviolet translucent plate or sheet, the front side of which is covered with an ultraviolet, opaque layer or coating broken into zones corresponding to a text or a figure. Grooves are cut into the transparent sign plate around these zones, and strings of fluorescent plastic material are set into these grooves, both steps being somewhat difficult to accomplish and time consuming.

The invention of the '019 patent is also an improvement over U.S. Pat. No. 3,978,599 to Berger, wherein the text material projects rearwardly away from the viewer and toward the light source to gather light and enhance the amount of light seen directly by the viewer to reveal the whole of the configuration of broken zones in the opaque layer. No light reflective surface covers the openings of these broken zones, and so the viewer sees the whole text lighted rather than an outline and aura around the text.

The invention of the '019 patent is also an improvement over the sign plate disclosed in U.S. Pat. No. 2,071,239 to Spencer et al., wherein an excavating operation (preferably performed by sand blast) is utilized to form a design, letter or legend in solid bodies of glass which then protrude in bold relief from a roughened temporary surface left by the sand blasting operation to form protruding lens-like bodies of translucent or transparent material standing out in strong relief with respect to a background of contrasting character. It appears that the ambient light reflects variously from the resulting differing surfaces to create certain effects.

The invention of the '019 patent is also an improvement over U.S. Pat. No. 1,887,523 to Schenkel. The Schenkel reference utilizes opaque (black) layers. Black blocks light but does not reflect light. The Schenkel reference shows ways of blocking light to achieve the illusion of depth and shaded effect to simulate blocked letters or gas filled tubes (Column 1, lines 32–34), but the reference does not show or suggest reflecting surfaces to guide light rays for enhancing effects, such as creating an aura around an outline or contour of the matter to be communicated.

In contrast to the devices of these references, the structure disclosed in the '019 patent is easier and less expensive to produce and, in addition, provides effects not achieved in those devices. The structure of the '019 patent creates a particularly strong outline with aura around the matter to be communicated, especially if the side edges of the projecting fluorescent material are in general register on the front side of the base plate with the configuration of the broken zones on the rear side of the plate and if the side edges are inclined in relation to the sign plate's front face. In this connection, the inclined edges preferably form an angle of about 120 degrees to about 150 degrees with respect to the front face of the sign plate.

In accordance with the '019 patent, the text or figures or art work will be exceptionally clear if a layer of color is additionally placed on the front light reflective layer, especially if that color is different from the color of the remaining part of the sign plate. Thus, in a preferred structure of that invention, the opaque layer is provided on the rear of the foundational or light transmitting plate, but with a layer of color first applied intermediate the rear face of the light transmitting plate and the front face of the opaque layer. This structure allows the color to be seen through the light transmitting plate from the front, giving the sign its base color. The opaque layer in that invention may also be of a light reflective material or at least include a light reflective layer on its rear face to reflect light from the light source and increase the overall light emission from the sign plate in its operational condition.

Nonetheless, experience with the device of the '019 patent has revealed elements that desirably should be improved. For example, the light source preferably is ultraviolet (black) light. A sign built in accordance with that invention is most effective, therefore, in only low light or dark ambient conditions. It exhibits low illumination output and the aura is less pronounced in indoor lighting and daylight conditions. Furthermore, the forming of the fluorescent plastic into the desired configuration by the process of routing, including the preparation phases both before and after the routing, is labor intensive and a relatively slow process, affecting the costs of production and the ability to provide sample forms quickly at less costs. Even though mill-cutting in an automatic process, or molding or casting might reduce some of the labor costs per unit, the placing of the fluorescent materials on the sign plate is done by hand and requires accurate and skilled handwork.

Accordingly, it is desired to provide a sign plate producible by methods resulting in still higher productivity, more flexibility, and less costs and having a structure providing a brighter light output. Such a sign plate then could be released from its dim operating surroundings and be useful in daylight surroundings, thereby becoming a more acceptable product in the market. Space taken by the complete sign box is another consideration. The light source, to be most effective in the '019 patent, is preferably spaced a distance from the rear of the sign plate and away from the opaque layer to allow more of the rays to pass through the openings of the zones broken in the opaque layer for transmission through the thickness of the base plate to reach and activate the fluorescent plastic on the front side of the base plate. The space between the light source and the base plate, of course, restricts the minimum thickness or depth of the physical construction of the sign box that contains the sign plate and the light source.

SUMMARY OF THE INVENTION

It is an object of this invention, therefore, to provide an improved sign plate for an illuminated sign that is economical to manufacture, that provides increased brightness in its output, that can allow a complete sign to be smaller in depth or thickness, that permits more flexibility in both structure and content, and that can utilize materials and methods available for use in such manufacture.

BRIEF DESCRIPTION OF THE DRAWINGS

Other objects and advantages of the invention will become apparent and the invention better understood by reference to the following detailed description read in conjunction with the accompanying drawings, in which.

DETAILED DESCRIPTION OF FIGS. 1 AND 2, PRIOR ART

Figure 1:
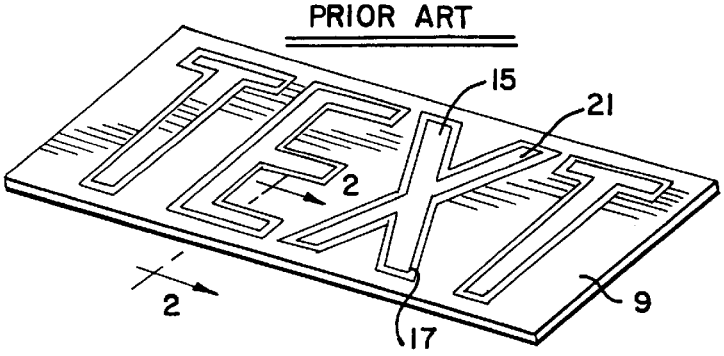
FIG. 1 PRIOR ART
FIG. 1 is a perspective view of a sign plate in accordance with prior art.
Figure 2:
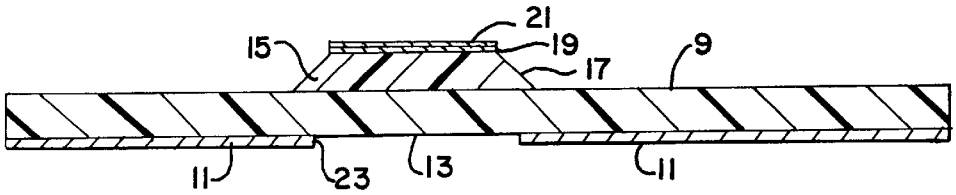
FIG. 2 PRIOR ART
FIG. 2 is a partial sectional view of the sign plate according to the prior art sign plate taken along the line 2—2 of FIG. 1.

Referring now to the drawings, in accordance with prior art, FIG. 1 shows a sign plate which includes an ultraviolet light transmitting plate 9. This plate forms the basic structure for the sign plate. The light transmitting plate 9 may be made of ultraviolet transmitting acrylic plastic. This plate is provided with an opaque reflective layer 11 on one of its faces. The top face, as viewed in the drawing of both FIGS. 1 and 2, is the front face or surface of the sign plate, and is the face seen by a viewer when the sign is mounted for illumination in a box or other suitable structure along with a light source for display. In FIG. 2 the opaque layer 11 is illustrated as applied to the back or rear face or surface of the light transmitting plate 9.

The word "text" on the front face of the light transmitting plate 9 in FIG. 1 is representative of matter that is intended for visual communication when the sign plate is installed and illuminated in a completed sign. In addition to letters, this intelligence or communication matter also might include figures, ornaments, legends, and the like. The detail that forms the matter to be communicated includes broken zones 13 in the integrity of the opaque layer 11. The broken zones form a configuration that defines the matter to be communicated. In register with this configuration of broken zones is a projecting detail 15 that forms a relief with respect to the front surface of the plate 9. The projection 15 is preferably made of a fluorescent material, such as fluorescent acrylic plastic. The projection 15 may be affixed in register with the broken zones 13 by any suitable means, such as bonding to the front surface of the plate 9 by an acrylic adhesive.

This projection 15 has inclined side edges 17 and the width of the base of the projection 15 is preferably slightly more than the width of the broken zones 13 in the reflective layer 11. The projection 15 has a configuration that matches the configuration of the broken zones 13. The slight additional width therefore assures complete coverage of the configuration of the broken zones 13 by the configuration of the projection 15. When the rear of the plate 9 is exposed to light, the light passes through the broken zones 13 of the opaque layer 11, through the thickness of the base plate 9 and then activates the fluorescent material of the projection 15. The front of the projection 15 (i.e., that surface which faces the viewer) is provided with a light reflective layer 19. This layer 19 could be an opaque ink applied by a suitable means, or it could be a foil. Further, a layer 21 of color is applied on the front of the light reflective layer 19.

On the rear of the sign plate 9, sandwiched between the rear surface of the sign plate 9 and the reflective layer 11, is a color layer 23 which, through the transparency of the sign plate 9, determines the base color of the sign. The front color layer 21 may be selected to coordinate with the base color layer 23.

By exposing the sign plate 9 to a light source (not shown), preferably an ultraviolet light source, behind the sign plate 9 (below the views as seen in the FIGS. 1 and 2), some light rays will reflect directly from the reflective layer 11 on the rear of the sign plate 9. Others of the ultraviolet rays will pass into the transparent plate 9 through the broken zones 13 in reflective layer 11 and into the projection 15 to activate the fluorescent material and make it glow. Part of the light rays produced from the activation of fluorescent material will escape through the inclined side edges 17. When viewed front on, the effect is to give a distinct illuminated outline of the configuration defining the matter being communicated. Thus, the mid-portion of the configuration is darkened because of the opacity of the material, and only the outline or bordering area of the configuration is illuminated.

Other ultraviolet rays produced from the activation of the fluorescent material are reflected by the reflective layer 19 to strike the front surface of the reflective layer 11 and reflect to the front of the sign. These rays appear as an aura around the configuration defining the matter being communicated against the colored background 23. The aura is enhanced when the opaque layer 11 is applied to the rear of the plate 9 vis-à-vis the front of the plate. Hence, overall, the structure shown in the drawing is preferable. The layer 11 is preferably both for opacity and reflectance.

As mentioned earlier, the configuration of fluorescent material can be mill cut in an automatic process, or it can be molded or cast or cut by a router. An advantage of the router is the ease of adjusting the angle in which the side surfaces 17 are cut. Even though preparing such a configuration and affixing it as a projection to the front surface of the sign face is an improvement over the references described earlier, it has been found desirable to improve the structure and the method of making the sign plate of the '019 patent to effect increased brilliance in the illumination of the sign, lower costs in producing the sign, smaller overall sign package, more flexibility in the production of the sign plate, and more possibilities for creativity in the presentation of communication.

DESCRIPTION OF THE PREFERRED EMBODIMENTS OF THIS INVENTION

Figure 3:
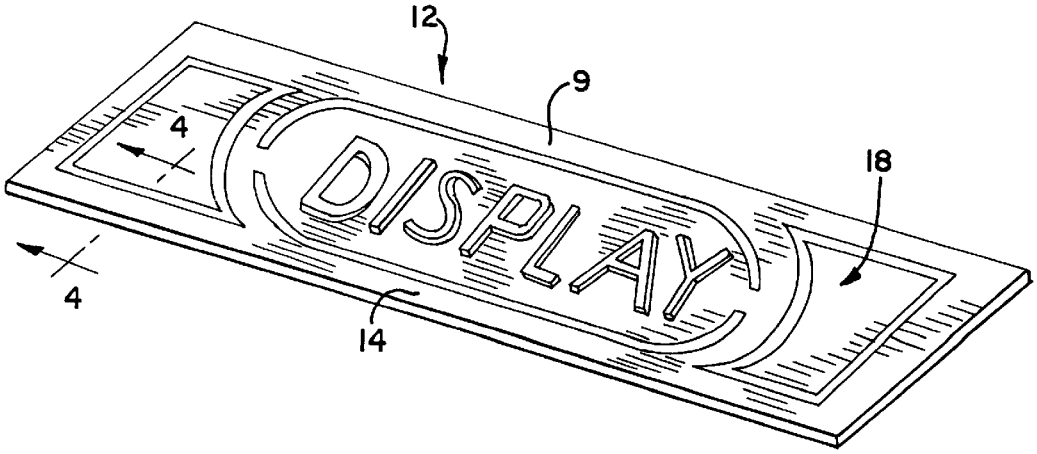
FIG. 3 is a perspective view of a sign plate in accordance with this invention.
Figure 4:
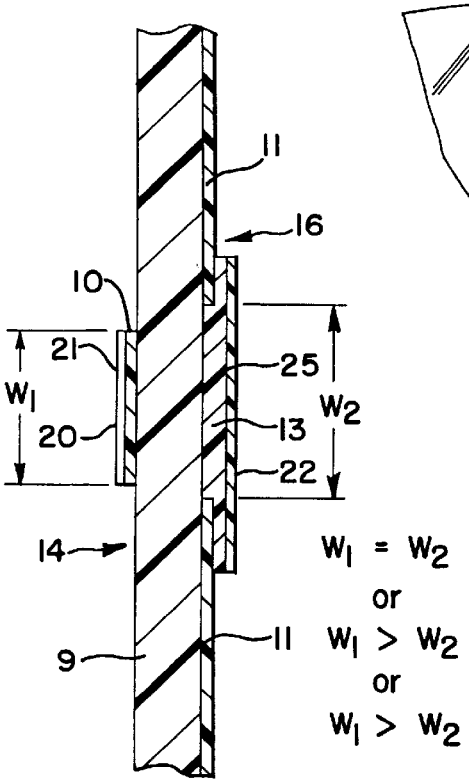
FIG. 4 is a partial sectional view of the sign plate according to this invention taken along line 4—4 of FIG. 3.

In accordance with this desire, FIGS. 3 and 4 show an embodiment of this invention that creates a similar light effect as in the '019 patent in that a glowing contour with aura occurs around the letters, figures, and designs. This embodiment, on the other hand, contemplates substantially flat faces on both surfaces of a sign plate 12 compared to the projection of the fluorescent plastic material in the '019 patent. Furthermore, a light diffusion layer, which may be or at least includes fluorescent material, can be only a thin layer or coating applied to the rear face of the sign plate 12 compared to a need for a projection of fluorescent material on the front face in the '019 patent. As will be seen, this invention also more effectively utilizes the concept of guiding the light beam by reflectance, even to blank out, multiply, and modify color, and to provide for more creativity in the design and use of the sign plate. These and other distinctions along with their advantages will become apparent upon reading the detailed description of the present invention that follows.

Referring to FIGS. 3 and 4 of the drawings, a preferred embodiment of the sign plate 12 of the present invention includes a light transmitting plate 9 which provides the basic structure of the sign plate. This light transmitting plate 9 may be made from a sheet of light transmitting material, such as clear plastic or glass. By way of example only, the plastic material can be sheets of solid resinous material sold under the trademark "Plexiglass" of Rohm and Haas Company. Many other materials are suitable for the purpose, however, and so no limitation is intended by the example. The light transmitting plate 9 is provided with an opaque reflective layer 11 on one of its faces. The top face viewed in the drawing in FIG. 3 is a front face or surface 14 of the sign plate 12 and is the face seen by a viewer when the sign is mounted for illumination in a box or other suitable structure (not shown), along with a light source, for display. In FIG. 4, the opaque reflective layer 11 is illustrated as applied to a back or rear face or surface 16 of the light transmitting plate 9.

The word "display" and an arbitrary design 18 are shown on the front face 14 of the light transmitting plate 9 in FIG. 3, and these are representative of intelligence or matter that can be visually communicated by the sign plate 12 when a whole sign incorporating this is installed and illuminated. In addition to the communication matter already suggested, figures, ornaments, legends, and the like are included.

The detail that forms the matter to be communicated includes broken zones 13 in the integrity of the opaque reflective layer 11. The broken zones form a configuration that defines the intelligence or matter to be communicated. The opaque reflective layer 11 and the broken zones 13 are preferably on the rear face 16 of the light transmitting plate 9.

A very important aspect of this invention is the ability to control and guide light rays to achieve certain pleasant third dimensional and/or colorful effects with a minimum of materials. For example, the effect of an illusion created inside the light transmitting plate 9 by using the thickness of the plate itself rather than by gluing additional materials on the surface of the plate. The following paragraphs describe how the light rays are controlled and guided to bring about these effects.

Placed on the opposite side or front face 14 in general register with the zones 13 is another layer 10 that is at least a reflective layer and is in a configuration corresponding to the configuration of the zones 13. Accordingly, if, for example, the zones spell the word "display", then the configuration of the reflective layer 10 also spells the word "display" on the front face 14 of the plate, as seen by the viewer. The opaque reflective layer 11, as implied, has the qualities of both opacity and reflectiveness. These qualities may be achieved by use of print ink, silk screen paint, foil, and the like. One example of material that can be used is polyvinylchloride adhesive foil which is commercially available in many colors. Thus, the foil already has a color base, is reflective and, at least one side, includes an adhesive coating in the color of the material. While such foil is useful for providing reflection and a color base, it may be inadequate for opacity. Hence, if opacity is also desired, a light impervious layer such as dark paint or ink can be applied to the non-adhesive side of the foil. This layer brings about the opaque characteristic, but the dark layer is not necessarily reflective. Generally, thin layers of reflective colors are not opaque and dark colors and black do not reflect. A reflective surface may not be needed on the rear face of the layer 11 on the rear of the plate, but if it is wanted an added reflective layer can be applied over the light impervious layer.

Figure 5:
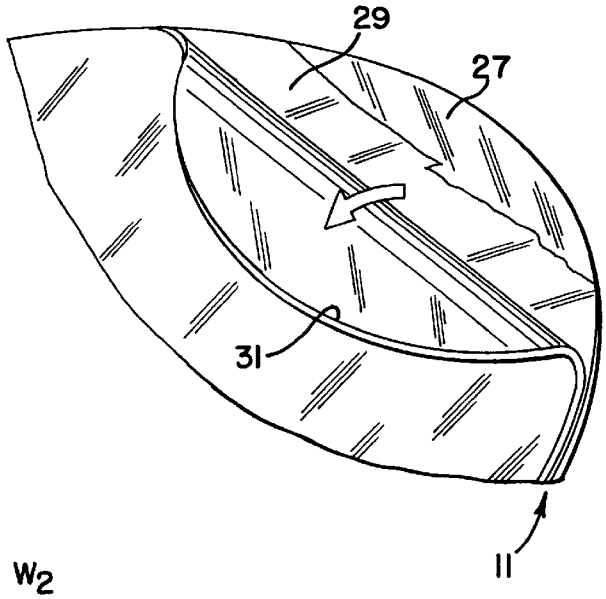
FIG. 5 is an enlarged fragmentary view of a portion of the sign plate of FIGS. 3 and 4 illustrating the detail of a possible composition of the opaque light reflective layer 11 showing corners peeled back to reveal component layers.

An example of these component layers that may constitute the opaque reflective layer 11 is seen in FIG. 5 where the basic adhesive foil (adhesive side down and not shown) is indicated at 27, the light impervious layer is indicated at 29, and an added reflective layer is indicated at 31.

Assume, for example, a design with printing as illustrated in FIG. 3 is desired for the sign plate 12. A background of white is chosen. A sheet of white polyvinylchloride adhesive foil 27 is selected. As is the commercial practice, the foil is provided on a roll and the adhesive surface is covered with a slip sheet (not shown) which is removable when the foil is to be applied to the surface of the light transmitting plate 9. Next, the light impervious layer 29 is applied to the foil 27 on the surface opposite the adhesive/slip sheet. The additional reflective layer 31, if it is to be applied, is then applied over the light impervious layer 29.

While the slip sheet still covers the adhesive surface, the design and the letters are cut from the sheet in a known manner, such as by a computer controlled plotter, to form the desired broken zone configuration of the message and/or design in the foil 27. The cutout matter that is not to be put on the light transmitting plate 9 is then peeled away and removed. A so-called working foil (also called an application foil) is applied on top of the remaining material that surrounds the configuration. The adhesive on the "working foil" is somewhat stronger than the adhesive on the slip sheet, and the remaining material adheres to the "working foil" holding the open zones of the configuration intact. The plotter is so accurate as to cut only through the material to, but not through, the slip sheet that covers the adhesive layer. Thus, the working foil can lift off the desired remaining portion surrounding the configuration from the slip sheet, exposing the adhesive layer of the remaining portion for application of it directly to the rear face 16 of the light transmitting plate 9. The working foil with this remaining portion is then applied to the rear face 16 of the light transmitting plate 9 with adhesive side to the rear face 16 and is pressed firmly against the plate 9, transferring the remaining portion to the plate 9. The adhesive force on the plate is now stronger than the adhesive force of the working foil, allowing the working foil to be removed from the remaining portion. The position of the configuration openings in the integrity of the opaque reflective layer 11 is thus established on the rear face of the light transmitting plate 9 to form the foundation or base of reference for further relevant reflective layers to be used to complete the sign plate in a manner that will control the light rays and achieve the objectives for any given sign.

A reverse type operation now takes place for the layer 10 to be applied to the front face 14 of the light transmitting plate 9. The configuration for the layer 10 is cut, for example, also by a computer controlled plotter. In this instance, all but the communication configuration is first peeled off and removed from the slip sheet before another "working foil" is carefully applied to adhere to the cutout configuration and remove it from the slip sheet. The entire configuration is held intact by the working foil, which then may be used to align and apply the configuration on the front face 14 in substantial register with the open broken zones 13 on the rear face 16 of the light transmitting plate 9.

It should be understood that these front and rear configurations can also be applied by known printing processes and by known silk screening processes. A printing process is particularly applicable to mass production, and this is particularly advantageous when large quantities of sign plates with the same message and design are to be produced. The cut foil method is more universal and useful for samples and small quantity production.

A light diffusion layer 25 is then applied on the rear face 16 of the light transmitting plate 9 to at least the exposed plate surface within the broken zones 13 of the configuration. The primary purpose of the light diffusion layer 25 is to scatter or break up and distribute light generally uniformly from its concentration as emitted from the light source. Thus, the light source per se will not be observed by the viewer, only uniformly transmitted light from the rear of the sign plate. This light diffusion layer 25 may be a plastic layer in the form of an opal or milky white translucent material.

In instances when white outlines only are desired, the light diffusion layer 25 of a milky white material can provide a working sign. Further characteristics of this light diffusion element, however, are to also add color and to intensify the light emitted from the front of the sign plate. A fluorescent color in a paint layer, ink layer, or plastic layer of itself can satisfy all these desired characteristics, i.e., light diffusion, color, and light intensity. Fluorescent material, when activated by a light source, will intensify certain frequencies visible to the human eye and glow in the color of the material. For these purposes only, therefore, a fluorescent material layer could be used without the milky white layer, but a very desirable special third dimensional effect, described later, is also provided by the additional use of the milky white layer along with the fluorescent color layer.

Accordingly, the light diffusion layer 25 may be of milky white translucent material, it may be a fluorescent layer 22 only, or it may be a combination of these two layers. Preferably, the layer 25 also will include a layer of fluorescent material 22 which may be applied to the milky white plastic by such means as silk screen process using a fluorescent silk screen paint, a spray process using a fluorescent paint, a printing process using a fluorescent ink, or by even affixing a thin sheet of fluorescent plastic material to the milky white plastic. The combination is applied to the plate 9. The fluorescent material may be selected in a color suitable to accomplish a desired effect on the completed sign (not shown) in conjunction with the other color layers of the sign plate 12.

Figure 7:
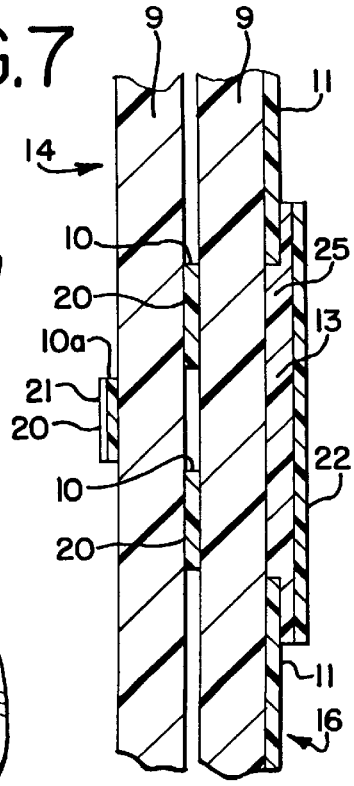
FIG. 7 is a partial sectional view of the sign plate according to the illustrated alternative embodiment of the invention taken along the line 7—7 of FIG. 6.

It should be noted that the layers 10, 11, 21, 22, and 25 in FIGS. 4 and 7 are drawn with enlarged cross sections for purposes of illustration only, and the drawings of the layers are not representative of the relative thickness of the layers. The layers in fact may be only a film, but to understand the drawings, the layers are blown up in cross section for ease of description.

In contrast to the prior art device in FIG. 2 where the fluorescent material is applied to the front of the sign plate as a relatively thick projection 15, the light diffusion layer 25, which may also include the fluorescent layer 22, of the present invention is applied on the rear face 16 of the plate to directly cover the broken zones 13. This structure provides a particular advantage over the illustrated prior art device because the diffusion layer and, if applied, the fluorescent layer is activated directly and generally uniformly by complete exposure to any kind of a light source at the rear of the light transmitting plate 9. This structure is so effective that the light source may be even immediately adjacent the layers 22 and 25 without losing luminescence on the parts of the configuration that are somewhat distant from the light source.

In this connection, the light source may be any kind of light, such as incandescent, fluorescent, neon, ultraviolet, light-emitting diodes (LEDs: rectifying semi-conductor devices that convert electrical energy into electromagnetic radiation), and electroluminescence (the application of an electric field to a material, usually solid, such as a fluorescent plastic plate). In the instance of electroluminescence, an electrically excited material in combination with a fluorescent sheet therefore could be its own source of light and substitute for the light source. Also, by using neon in a desired color in combination with the light diffusion layer 25 when the light diffusion layer is of milky white material, the fluorescent layer 22 could be omitted and still achieve good lighting results. The sensitivity of neon and the maintenance required by it would generally suggest avoiding this alternative, however.

By exposing the sign plate 9 to a light source (not shown), preferably a light source placed facing the rear face 16 of sign plate 12, light rays will pass onto and directly activate the entire fluorescent layer 22 and/or directly light the diffusion layer 25, both or either of which may cover primarily only the broken zones 13. The glow of the activated fluorescent layer and/or the light of the diffusion layer directly covering the broken zones 13 in the reflective layer 11 will then extend through the transparent plate 9. Part of these light rays will pass directly to the viewer along the side edges of the front reflective layer 10 to present the outline or contour of the configuration to the viewer.

With reference to this outline or contour, the layer 10 may be either an opaque reflective layer or simply a reflective layer in accordance with this invention. In either instance, some rays from the rear face 16 will reflect from the reflective surface of the layer 10 back to the opaque reflective layer 11 and thence forward to the viewer to form an aura around the outline. The difference whether opacity is included in the layer 10 will be, however, in the appearance of a core area 20 within the outline. If the layer 10 includes a light impervious layer 29 to provide the opacity, then the core area 20 within the outline will be lighted only by existing front lighting from the surroundings, and the color of the core area 20 will be the color of the front surface of the layer 10 (which may be a front color layer 21). On the other hand, if the layer 10 lacks the light impervious layer 29, then some light from the rear will influence the core area 20, illuminating it to some degree and, if the core area also includes fluorescent matter (described below), with the color from the fluorescent color matter in that layer 10. Because the layer 10 is reflective and reflects rays, the intensity of the lighted core area will be lower compared to the direct rays to the viewer from the rear around the edges of the core area 20. Thus, an outline of the configuration is present, but the contrast between it and the core is less than when the core area is opaque.

Alternatively, the layer 10 also could be a fluorescent layer that would both reflect rays from the layers 22 and 25 and be activated by the rays to fluoresce the core area 20. Depending upon the colors selected, this can create an interesting combination of colors. For example, if the rear fluorescent layer 22 is blue and the front fluorescent layer in the position of the layer 10 is red, the viewer would see a mixture of red and blue (purple) in the core area 20 with an outline of blue, and if the rear fluorescent layer 22 is white and the front layer is yellow, then the viewer would see a yellow core with a white outline. The aura in each of these examples will also be influenced by the basic color of the sign plate as determined by the color of the layer 11.

Colors to achieve special effects may be selected in any desired combination of the opaque reflective layer 11, the fluorescent layer 22, the reflective layer 10, and the additional front color layer 21. In this connection, it is known that a color of light may be used in confrontation with another color of light to effectively cancel, amplify, or modify the resulting color, depending on the color selections and intensity. This technique may be used effectively in the structure of this invention.

Another important aspect of this invention is the ability to apply a varying color base in a manner not believed used heretofore. When using the fluorescent layer 22, the color may be gradually changed along the layer. For instance, a length of fluorescent blue can be applied. Then, from the middle of this blue, a length of fluorescent red is applied, half covering the blue and the other half on the exposed milky white material. Thus, in the total applied strip of fluorescent color layer, the color would change from blue to purple to red without a precise line of demarcation between the colors. Other colors may be applied as desired. The effect of this on the sign plate length is to change colors of the outline and aura from one position to another. Many or few color changes could be used in this manner on the sign plate.

The angle of an imaginary line joining an edge of the layer 11 at a point along an edge of the broken zone 13 with a corresponding point on the edge of the layer 10 on the front face 14 will form the illusion of the equivalent to the inclined side edges 17 of the prior art device shown in FIG. 2. This angle may be increased or decreased by decreasing or increasing, respectively, the corresponding dimensions of the configuration of the layer 10. This illusion is achieved without the physical presence of the projection 15 on the front face 14 of the plate 12 of the prior art device.

The thickness of the illusion of the slanting side edge can be controlled from between 0.0 mm up to 20 mm or more according to the thickness of the material selected for the light transmitting base plate 9. Further, a front color layer 21 may be applied to the front of the layer 10. This color layer 21 may be selected to coordinate as desired with the background color of the opaque reflective layer 11, the base color of the sign plate.

The front face letters, figures, design or art work correspond to the configuration of the broken zones on the rear face. In accordance with this invention, the front configuration may be dimensionally smaller, the same as, or larger than, the rear configuration. The light rays passing from the light source through the broken zones will still form an outline around the front configuration unless the dimension of the front configuration intentionally over extends the rear configuration to effectively eliminate the outline, albeit not the aura. The illusion of the slanted edge and third dimension, however, will be most effective when the front dimension is no greater than the rear configuration dimension and preferably is less. The effects of the illusion of the slanted side edge, of the depth or third dimension, of the aura, and of many possible colors to achieve a particular objective for any given sign are created by controlling several factors discussed hereinafter. Suffice it to say for now that after considering these factors, a dimension will be selected for the width of the front configuration, and the configuration will be cut from another sheet for the layer 10 in the manner already described.

In addition to the illusion of an inclined side edge in this invention that compared to the physical inclined edge 17 of the prior art shown in FIG. 2, there is also the effect of depth or third dimension where the viewer sees "inside" the light transmitting base plate 9. This plate, as already indicated, is preferably clear plastic and transparent. At best, objects are "out of focus" when viewing through the clear plastic to the milky white layer. Such is desirable when considering quality of the third dimensional effect.

An object or layer on the rear side of the light transmitting plate 9 is clearly and sharply seen as through clear plastic. The purpose of the light diffusion layer 25 is to distribute light evenly and uniformly. This becomes diffused or "out of focus" light and is seen through the inclined edges of the configuration so that the distance to the light source cannot be detected by the viewer. On the other hand, a distance between the rear reflective layer 11 and the front layer 10 is realized even though no direct connection is between them. When the diffusion layer is activated by light, the viewer is able to detect spacial difference between the back and the front reflective layers but not able to detect the distance to the light source. It now appears that the light connects both the front layer and the rear layers, giving it extra third dimensional and massive appearance. The less diffused the light source, the less quality of this special appearance. The effect approaches an illusion of a "bottomless" depth. Thus, a mix of colors might appear, for example, in space in a luminous phenomenon similar to a view of the aurora borealis. Colors appear to be within the plate itself. The rear milky white diffusion layer 25 also creates interesting effects third dimensionally with the confrontation of reflected rays from the layer 10, especially if the layer 10 also is fluorescent as mentioned earlier. Thus, a milky white light diffusion layer 25 along with the fluorescent color layer 22 is preferred where unusual depth effects are desired.

Another interesting effect can be achieved when aligning the configuration on the front face with the broken zones of the configuration on the rear face. A partial outline on each character can be made by slightly laterally shifting or offsetting the two configurations with respect to each other. For example, the left side of the characters can be made without outline, but with aura, and the right side with both outline and aura. The outline may be wider, depending on the initial selection of the comparative dimensions in cutting the configurations.

This flexibility of the invention is advantageous in that relatively inexpensive production methods and materials, as herein exhibited, may be used to create quality third dimensional effects within the plate without the need for a physically real third dimensional object to create it. The viewer expects to feel a third dimensional front face on the sign plate if he touches it rather than feeling the substantially flat surface that it has, and the viewer likely will be unable to realize the distance to the light source.

Figure 6:
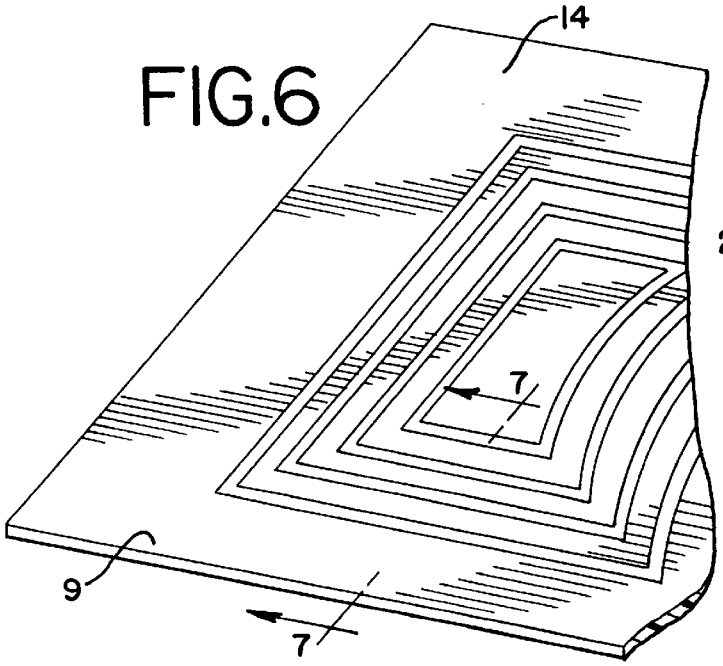
FIG. 6 is a fragmentary enlarged view of a portion of the sign plate of FIG. 3 illustrating an example of an alternative embodiment of the invention.

Another embodiment of this invention is seen in FIGS. 6 and 7. The same principles already described for FIGS. 3 and 4 apply to this embodiment as well. Furthermore, this embodiment allows more flexibility in the utilization of the principles. For example, it is possible with this embodiment to have an artistic design outlined and communicated as described above, while at the same time to have a layer of letters transmitting a message on top of or across the artistic design or vice versa. In fact, either can be the foreground and the other the background at one point and reverse their roles at another point. This is done by creating an "outline and aura" within the boundaries of or on top of or cross another "outline with aura".

An example will illustrate this flexibility. With reference to FIG. 7, by exposing the rear face 16 of the sign plate 12 to a light source (not shown), the light rays will activate or energize the light diffusion layer 25, which preferably includes a layer 22 of fluorescent color, and make it glow uniformly. Part of the light rays produced from the activation of the fluorescent material will pass directly forward to the viewer in the areas between the generally facing side edges of the spacially offset opaque reflective layer 11 and the reflective layers 10 and 10*a* as seen in FIG. 7. This light passing between these facing edges forms an outline, as explained previously. The fact that the light rays also reflect from the reflective layers 10 and 10*a*, means that some of the light rays will reflect from the more forward of the offset layers 10*a* back to the front surfaces of the layers 10 and 11, thence to the front toward the viewer. These light rays reflected from the front of the opaque reflective layer 10 provide the aura around the outline formed on the edges of 10*a*. Another outline also exists around the outside edges of the layer 10 with aura from the reflection from the front of layer 11 as previously described. This creates the outline or contour with aura within the boundaries of or across another outline or contour with aura.

As also indicated previously, a color layer 21 may be applied to the front surfaces of the front opaque reflective layer 10*a* to provide a special color effect in addition to the colors of the layers 11, 10, and 10*a*. The opaque reflective layer may inherently have a color that is useful, but it may be found that a mixing of colors in the various layers presents interesting effects. In addition, the front side of any of the reflective layers may include a color layer 21 (not just 10*a*) to further effect layers of different colors to bring about these desirable color effects. If the color layers 21 are different in color from the light diffusion/fluorescent layers 22 and 25, then the auras created will likely be viewed as different in color from the outlines formed by the rays passing directly from the fluorescent material to the viewer. Also, as already indicated, the fluorescent color layer 22 on the light diffusion layer 25 may be varied along its surface to add to the interest, and it is known that colored light can be used in direct confrontation with another colored light to cancel, amplify, or change the resulting color. This alternative structure provides an excellent arena in which to exercise such use of color. It can be seen, therefore, that this structure allows for many innovative creations.

Figure 8:
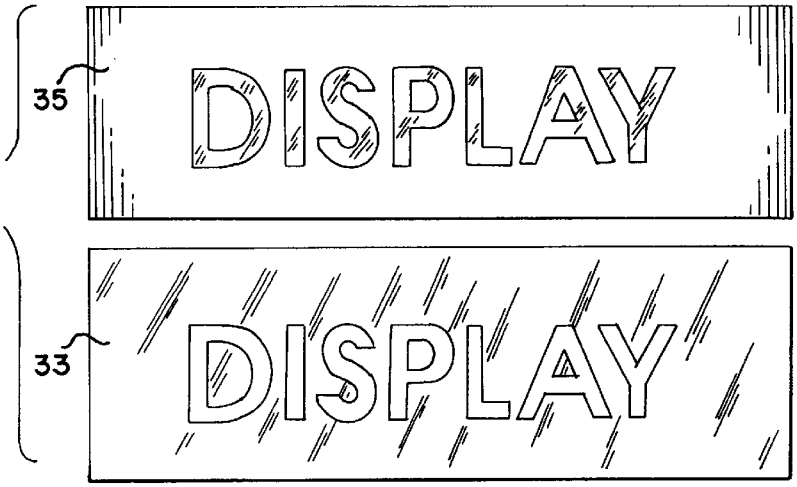
FIG. 8 is a plan view of a rear layout panel and of a corresponding front overlay panel useful in another embodiment of the invention.
Figure 9:
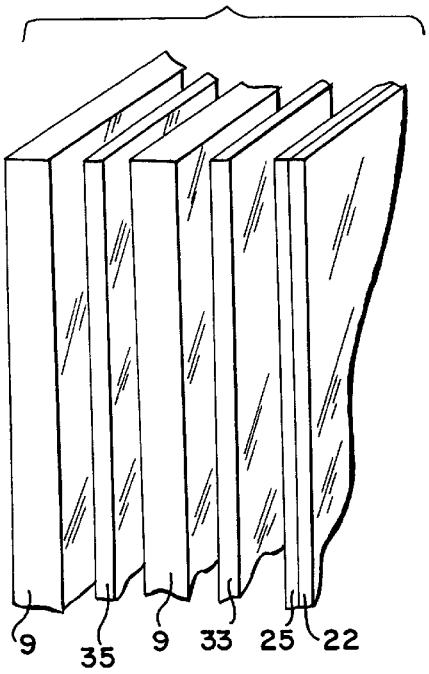
FIG. 9 is an exploded end view of the embodiment of FIG. 8 during assembly of the sign plate.
Figure 10:
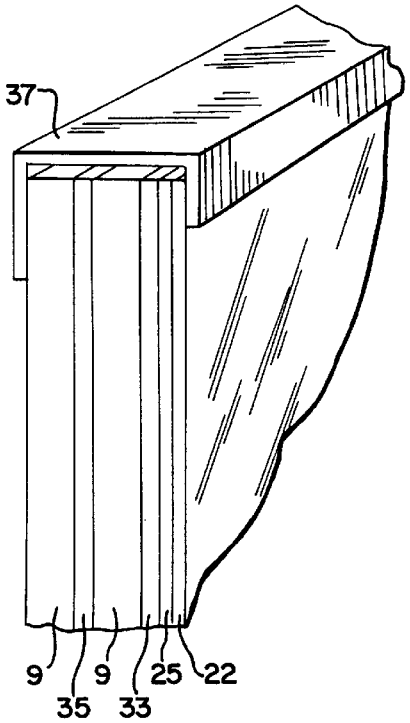
FIG. 10 is an end view of the embodiment of FIG. 8 after assembly of the sign plate.

Still another embodiment is shown in FIGS. 8–10. The effects of this sign plate in a sign are, or can be, the same as those for the embodiments already described, but the physical implementation of this sign plate allows some further flexibility in use of a sign constructed in accordance with the invention. Instead of applying an opaque light reflective layer directly to the rear face 16 of a light transmitting plate 9 by adhesive material, the letters, figures and/or artistic design are printed directly onto clear thin plastic foil or film having, for example, a thickness of from 0.2 to 0.5 mm. Known printing techniques may be employed for this printing using standard forms, letters, figures, and characters to reduce print costs as compared to silk screen and other specialty or custom methods. An example of a use for such a sign is where the sign is intended to serve in a situation where conditions change frequently and where the communication needs to change with the conditions. The frequency period might be every few days or even only every few hours. A specific example is a restaurant advertising a menu for the day or for a meal.

A rear foil or film 33 is illustrated in FIG. 8 wherein the background is printed with opaque and reflective color inks leaving the communication configuration open as to the broken zones 13 through which the light rays pass. A front foil or film 35, also illustrated, the reverse of film 33, shows the communication configuration that is to be in register with the film 33. The front foil 35 has an opaque communication configuration with a clear background.

As seen in FIG. 9, several layers, including the films 33 and 35, are brought together to form a sandwich of superposed separate layers that, in the sandwich form, maintain their integrity of separate, removable layers vis-à-vis an integral lamination of layers according to the earlier described embodiments.

In this instance, the sandwich further includes a light diffusion layer 25, which may be a thin plate of opal or milky white plastic with a fluorescent color layer 22 applied to it, and two light transmitting plates 9 as earlier described. The printed films 33 and 35 are interposed between layers forming the sandwich; the rear film 33 being between the layer 25 and the rearmost light transmitting plate 9, and the front film 35 being between the rearmost light transmitting plate 9 and the frontmost light transmitting plate 9. All layers are aligned, but particular attention should be given to the positions of the films 33 and 35 with respect to each other. In accordance with the earlier embodiments, the front printing 35 will have a narrower configuration than the corresponding configuration printed on the rear film 33. The differences in the dimensions allow light rays to radiate directly from the layer 25 when activated by the light source (not shown) through the light transmitting plates 9 and to the viewer to form the outline or contour around the configuration. Hence, the films should be aligned to bring the two configurations in general register respectively. As described earlier in connection with the other embodiments, however, the top and bottom configurations may be shifted or laterally offset with respect to one another to achieve interesting outline effects.

Once aligned, the layers are locked together to retain their sandwiched relationship by use of suitable means represented by a bracket 37. The sandwiched sign plate then may be placed in its sign box (not shown) where, along with a light source, the illuminated sign is completed.

This structure, as may be appreciated, allows for an easy change of communication matter because of the discreteness of the parts of the sign plate in this embodiment.

As with the previous embodiments, the layers in FIGS. 9 and 10 are drawn with enlarged widths for purposes of illustration and ease of description only, and the drawings of the layers are not representative of the relative thickness of the physical layers. Also as with the previous embodiments, the rear of the sign plate in these figures (side of the light source) is to the right.

The principles of the sign plate disclosed herein have many diverse applications according to the creativeness of the person applying the principles. For example, in addition to the more usual applications of applying these principles to artistic displays, information dissemination, advertising, or any combination thereof, the principles could also be applied to other applications, such as faces for clocks, relief maps, and globes.

The advantages of the invention disclosed herein are many. The structure makes easier the job of standardizing the various parts of the sign plate. The structure also provides increased brightness in the light output, allowing for more effectiveness when used in ambient conditions having surrounding light. Less labor hours are required for producing the sign plate, and it can be quickly put together for a sample and be easily changed if desired. Almost any kind of light source can be used, and the light source can be directly adjacent the rear face of the sign plate, allowing for a very thin overall sign package (frame, sign plate, and light source). The concept of guiding the light beam allows for more creativity and flexibility in the making and using of the sign plate. Generally, the amount of material needed also is less.

Although the invention has been particularly shown and described with reference to a preferred embodiment and an alternative thereof, it will be understood by those skilled in the art that various changes in the form and details may be made therein without departing from the spirit and scope of the invention, which is defined by the following claims.

What is claimed is:

1. A sign plate for an illuminated sign that has a light source that illuminates said sign plate, the sign plate comprising a transparent light transmitting sheet, a first light reflecting layer on a rear face of the light transmitting sheet and having an opening therein defining a first indicia to be displayed by the sign, and a second light reflecting layer defining a second indicia, corresponding to said first indicia, on a front face of said light transmitting sheet;

a diffusion layer disposed in said opening on said rear face of said transparent light transmitting sheet so as to direct diffused light through said opening and said transparent light transmitting sheet;

wherein a width of said opening is greater than a width of said corresponding second indicia and wherein said opening and said second indicia are positioned such that when diffused light is directed through said opening and said transparent light transmitting sheet there is provided a three-dimensional effect of said first and said second indicia; and wherein a front face of said light transmitting sheet is positioned so that when said sign plate is mounted for illumination by said light source said front face of said light transmitting sheet is nearer to a viewer of said sign plate than said rear face of said light transmitting sheet so that said front face of said light transmitting sheet is seen by the viewer.

2. The sign plate according to claim 1, wherein said diffusion layer includes a fluorescent material.

3. The sign plate according to claim 1, wherein said diffusion layer is milky white.

4. The sign plate of claim 1, wherein said light source comprises an electroluminescence light source.

5. A sign plate for an illuminated sign that has a light source that illuminates said sign plate, the sign plate comprising a transparent light transmitting sheet, a first light reflecting layer on a rear face of said light transmitting sheet and having an opening therein defining a first indicia to be displayed by the sign, and a second light reflecting layer defining a second indicia, corresponding to said first indicia, on a front face of said light transmitting sheet;

a diffusion layer disposed in said opening on said rear face of said transparent light transmitting sheet so as to direct diffused light through said opening and said transparent light transmitting sheet;

wherein a width of said opening is greater than a width of said corresponding second indicia and wherein said opening and said second indicia are positioned such that when diffused light is directed through said opening and said transparent light transmitting sheet an aura around said first and said second indicia is formed; and wherein a front face of said light transmitting sheet is positioned so that when said sign plate is mounted for illumination by said light source said front face of said light transmitting sheet is nearer to a viewer of said sign plate than said rear face of said light transmitting sheet so that said front face of said light transmitting sheet is seen by the viewer.

6. The sign plate according to claim 5, wherein said diffusion layer includes a fluorescent material.

7. The sign plate according to claim 5, wherein said diffusion layer is milky white.

8. The sign plate of claim 5, wherein said light source comprises an electroluminescence light source.

9. A sign plate for an illuminated sign, the sign plate comprising a transparent light transmitting sheet, a first light reflecting layer on a rear face of the light transmitting sheet and having an opening therein defining a first indicia to be displayed by the sign and a second light reflecting layer defining a second indicia, corresponding to said first indicia, on a front face of said light transmitting sheet, wherein said opening and said second indicia are positioned such that when diffused light is directed through said opening and said transparent light transmitting sheet an aura around said first and said second indicia is formed;

an intermediate light reflecting layer located between said front light reflecting layer and said rear light reflecting layer, said intermediate light reflecting layer being shaped to define a second illuminated aura around said first and said second indicia;

wherein a width of said opening is greater than a width of said corresponding second indicia and wherein said opening and said second indicia are positioned such that when diffused light is directed through said opening and said transparent light transmitting sheet there is provided a three-dimensional effect of said first and said second indicia.

10. A sign plate for an illuminated sign that has a light source that illuminates said sign plate, the sign plate comprising a light transmitting sheet, a first light reflecting layer on a rear face of said light transmitting sheet, a zone breaking the integrity of said first light reflecting layer and defining matter to be communicated by the sign, a fluorescent diffusion layer on said rear face of said light transmitting sheet covering said zone, and a second light reflecting layer on a front face of said light transmitting sheet, said second light reflecting layer being patterned and in register with said zone whereby light transmitted through said light transmitting sheet from said diffusion layer is reflected by said second light reflecting layer back through said light transmitting sheet onto said first light reflecting layer, and an opaque layer on said second light reflecting layer, wherein said second light reflecting layer is translucent and said second light reflecting layer and said zone are mutually configured so that said diffusion layer is visible from said front face of said light transmitting sheet so as to provide an outline around said second light reflecting layer; and wherein a front face of said light transmitting sheet is positioned so that when said sign plate is mounted for illumination by said light source said front face of said light transmitting sheet is nearer to a viewer of said sign plate than said rear face of said light transmitting sheet so that said front face of said light transmitting sheet is seen by the viewer.

11. The sign plate of claim 10, wherein said light source comprises an electroluminescence light source.

12. A sign plate for an illuminated sign, the sign plate comprising a transparent light transmitting sheet, a first light reflecting layer on a rear face of said light transmitting sheet and having an opening therein defining a first indicia to be displayed by the sign, and a second light reflecting layer defining a second indicia, corresponding to said first indicia, on a front face of said light transmitting sheet, wherein a width of said opening is greater than a width of said corresponding second indicia and wherein said opening and said second indicia are positioned such that when diffused light is directed through said opening and said transparent light transmitting sheet an aura around said first and said second indicia is formed; and an intermediate light reflecting layer located between said front light reflecting layer and said rear light reflecting layer, said intermediate light reflecting layer being shaped to define a second illuminated aura around said first and said second indicia.

13. A sign plate for an illuminated sign that has a light source that illuminates said sign plate, the sign plate comprising a transparent light transmitting sheet, a first light reflecting layer on a rear face of said light transmitting sheet and comprising an opening therein defining a first indicia to be displayed by the sign, a diffusion layer disposed in said opening on said rear face of said light transmitting sheet, and a second light reflecting layer defining a second indicia, corresponding to said first indicia, on a front face of said light transmitting sheet, said second light reflecting layer comprising a rear-most reflective surface and being shaped and positioned so as to at least partially expose said diffusion layer therebehind;

wherein a width of said opening is greater than a width of said second indicia; and wherein a front face of said light transmitting sheet is positioned so that when said sign plate is mounted for illumination by said light source said front face of said light transmitting sheet is nearer to a viewer of said sign plate than said rear face of said light transmitting sheet so that said front face of said light transmitting sheet is seen by the viewer.

14. The sign plate according to claim 13 wherein said diffusion layer includes a fluorescent material.

15. The sign plate according to claim 13 wherein said second light reflecting layer is shaped and positioned whereby annular portions of said diffusion layer surrounding said second indicia are exposed by said second light reflecting layer.

16. The sign plate according to claim 13 wherein said first indicia is laterally offset with respect to said second indicia.

17. The sign plate according to claim 13 wherein said first light reflecting layer comprises an adhesive plastics foil.

18. The sign plate of claim 13, wherein said second light reflecting layer comprises a fluorescent material.

19. The sign plate of claim 13, wherein said opening and said second light reflecting layer are physically arranged relative to one another so as to create an outline, an aura and a three dimensional visual effect.

20. The sign plate of claim 13, wherein said light source comprises an electroluminescence light source.

21. A sign plate for an illuminated sign that has a light source that illuminates said sign plate, the sign plate comprising a transparent light transmitting sheet, a first light reflecting layer on a rear face of said light transmitting sheet and having an opening therein defining a first indicia to be displayed by the sign, and a second light reflecting layer defining a second indicia, corresponding to said first indicia, on a front face of said light transmitting sheet;

a diffusion layer disposed in said opening on said rear face of said transparent light transmitting sheet so as to direct diffused light through said opening and said transparent light transmitting sheet, wherein a width of said opening is greater than a width of said corresponding second indicia and wherein said opening and said second indicia are positioned such that when diffused light is directed through said opening and said transparent light transmitting sheet an illuminated outline at least partially around said first and second indicia is formed; and wherein a front face of said light transmitting sheet is positioned so that when said sign plate is mounted for illumination by said light source said front face of said light transmitting sheet is nearer to a viewer of said sign plate than said rear face of said light transmitting sheet so that said front face of said light transmitting sheet is seen by the viewer.

22. The sign plate according to claim 21, wherein said diffusion layer includes a fluorescent material.

23. The sign plate according to claim 21, wherein said diffusion layer is milky white.

24. The sign plate of claim 21, wherein said light source comprises an electroluminescence light source.

25. A sign plate for an illuminated sign, the sign plate comprising a front light reflecting layer having a rearwardly directed reflective surface, said front light reflecting layer defining an indicia to be displayed by the sign, a rear light reflecting layer spaced from said front light reflecting layer and comprising an opening therein corresponding to said indicia defined by said front light reflecting layer, and a light diffusion layer covering a rear surface of said opening, said front light reflecting layer and said opening being shaped and dimensioned with respect to each other so as to provide an illuminated outline at least partially around said indicia;

wherein said front light reflecting layer and said rear light reflecting layer are carried on respective first and second plastics sheets; and wherein said light diffusion layer comprises a third plastics sheet disposed behind said second plastics sheet.

26. The sign plate according to claim 25 wherein said plastics sheets are up to 0.5 mm thick.

27. The sign plate according to claim 26 wherein said front light reflecting layer and said rear light reflecting layer are printed films.

28. The sign plate according to claim 25 further comprising a light transmitting sheet between said first and second plastics sheets.

29. A sign plate according to claim 28 wherein said first and second plastics sheets and said light transmitting sheet are formed as a sandwich of superposed separate layers and said first and second plastics sheets are removable from the light transmitting sheet.

30. A sign plate according to claim 29 further comprising a bracket for removably locking the separate layers together.

31. The sign plate according to claim 25 wherein said front light reflecting layer and said rear light reflecting layer are configured so that light reflected from said front light reflecting layer onto said rear light reflecting layer creates an illuminated aura around said indicia.

32. The sign plate according to claim 31 further comprising an intermediate light reflecting layer located between said front light reflecting layer and said rear light reflecting layer, said intermediate light reflecting layer being shaped to define a second illuminated aura around said indicia.

33. The sign plate of claim 25, wherein said front light reflecting layer comprises a fluorescent material.

34. The sign plate of claim 25, wherein said opening and said front light reflecting layer are physically arranged relative to one another so as to create an outline, an aura and a three dimensional visual effect.

35. A sign plate for an illuminated sign, the sign plate comprising a transparent light transmitting sheet, a first light reflecting layer on a rear face of said light transmitting sheet and having an opening therein defining a first indicia to be displayed by the sign, and a second light reflecting layer defining a second indicia, corresponding to said first indicia, on a front face of said light transmitting sheet;

an intermediate light reflecting layer located between said front light reflecting layer and said rear light reflecting layer, said intermediate light reflecting layer being shaped to define a second illuminated aura around said first and said second indicia, wherein a width of said opening is greater than a width of said corresponding second indicia and wherein said opening and said second indicia are positioned such that when diffused light is directed through said opening and said transparent light transmitting sheet an illuminated outline at least partially around said first and second indicia is formed.

36. A sign plate for an illuminated sign, the sign plate comprising a transparent light transmitting sheet, a first light reflecting layer on a rear face of the light transmitting sheet and having an opening therein defining a first indicia to be displayed by the sign, a fluorescent layer disposed in said opening on said rear face of said light transmitting sheet, and a second light reflecting layer defining a second indicia, corresponding to said first indicia, on a front face of said light transmitting sheet, said second light reflecting layer comprising a rear-most reflective surface and being shaped and positioned so as to at least partially expose said diffusion layer therebehind;

wherein a width of said opening is greater than a width of said corresponding second indicia; and wherein said fluorescent layer emits at least two types of colored light.

37. The sign plate of claim 36, wherein a light source comprises an electroluminescence light source.

38. A sign plate for an illuminated sign that has a light source that illuminates said sign plate, the sign plate comprising a transparent light transmitting sheet, a first light reflecting layer on a rear face of the light transmitting sheet and having an opening therein defining a first indicia to be displayed by the sign, a fluorescent layer disposed in said opening on said rear face of said light transmitting sheet, and a second light reflecting layer defining a second indicia, corresponding to said first indicia, on a front face of said light transmitting sheet, said second light reflecting layer comprising a rear-most reflective surface and being shaped and positioned so as to at least partially expose a diffusion layer therebehind;

wherein a width of said opening is greater than a width of said corresponding second indicia; and wherein a front face of said light transmitting sheet is positioned so that when said sign plate is mounted for illumination by said light source said front face of said light transmitting sheet is nearer to a viewer of said sign plate than said rear face of said light transmitting sheet so that said front face of said light transmitting sheet is seen by the viewer.

39. The sign plate of claim 38, wherein said fluorescent layer emits colored light.

40. The sign plate of claim 38, wherein said opening and said first light reflecting layer are physically arranged relative to one another so as to create an outline, an aura and a three dimensional visual effect.

41. The sign plate of claim 38, wherein said light source comprises an electroluminescence light source.

42. The sign plate of claim 38, wherein said second light reflecting layer comprises a fluorescent material.

43. A sign plate for an illuminated sign, the sign plate comprising a front light reflecting layer having a rearwardly directed reflective surface, said front light reflecting layer defining an indicia to be displayed by the sign, a rear light reflecting layer spaced from said front light reflecting layer and having an opening therein corresponding to said indicia defined by said front light reflecting layer, and a light diffusion layer covering a rear surface of said opening, said front light reflecting layer and said opening being shaped and dimensioned with respect to each other so as to provide an illuminated outline at least partially around said indicia;

an intermediate light reflecting layer located between said front light reflecting layer and said rear light reflecting layer;

wherein said front light reflecting layer and said rear light reflecting layer are configured so that light reflected from said front light reflecting layer onto said rear light reflecting layer creates an illuminated aura around said indicia; and wherein said intermediate light reflecting layer being shaped to define a second illuminated aura around said indicia.

44. The sign plate of claim 43, wherein said front light reflecting layer comprises a fluorescent material.

45. The sign plate of claim 43, wherein said opening and said front light reflecting layer are physically arranged relative to one another so as to create an outline, an aura and a three dimensional visual effect.

46. A sign plate for an illuminated sign that has a light source that illuminates said sign plate, the sign plate comprising a transparent light transmitting sheet, a first light reflecting layer on a rear face of said light transmitting sheet and having an opening therein defining a first indicia to be displayed by the sign, and a second light reflecting layer defining a second indicia, corresponding to said first indicia, on a front face of said light transmitting sheet;

a diffusion layer disposed in said opening on said rear face of said transparent light transmitting sheet so as to direct diffused light through said opening and said transparent light transmitting sheet, wherein a width of said opening is greater than a width of said corresponding second indicia and wherein said opening and said second indicia are positioned such that when diffused light is directed through said transparent light transmitting sheet there is provided an illusion of an inclined edge of said first and said second indicia; and wherein a front face of said light transmitting sheet is positioned so that when said sign plate is mounted for illumination by said light source said front face of said light transmitting sheet is nearer to a viewer of said sign plate than said rear face of said light transmitting sheet so that said front face of said light transmitting sheet is seen by the viewer.

47. The sign plate according to claim 46, wherein said diffusion layer includes a fluorescent material.

48. The sign plate according to claim 46, wherein said diffusion layer is milky white.

49. The sign plate of claim 46, wherein said light source comprises an electroluminescence light source.

50. A sign plate for an illuminated sign that has a light source that illuminates said sign plate, the sign plate comprising:

a transparent sheet, a first light reflecting layer on a rear face of said transparent sheet and comprising an opening therein defining a first indicia to be displayed by the sign, a diffusion layer disposed in said opening on said rear face of said transparent sheet, and a second light reflecting layer comprising a rearmost reflective surface for reflecting light transmitted forwardly through said transparent sheet back onto a front surface of said first light reflecting layer, said second light reflecting layer being shaped to define a second indicia corresponding to said first indicia defined by said opening and being located laterally inwardly of said opening thereby to provide the thickness of said transparent sheet between said diffusion layer and said second light reflecting layer and to provide an illusion of an inclined edge of said second indicia; and wherein a front face of said transparent sheet is positioned so that when said sign plate is mounted for illumination by said light source said front face of said transparent sheet is nearer to a viewer of said sign plate than said rear face of said transparent sheet so that said front face of said transparent sheet is seen by the viewer.

51. The sign plate according to claim 50 wherein said inclined edge has a thickness of up to 20 mm.

52. The sign plate according to claim 50 wherein said diffusion layer is fluorescent.

53. The sign plate according to claim 50 wherein said diffusion layer is milky white.

54. The sign plate according to claim 50 wherein said first light reflecting layer comprises a self-adhesive plastics film.

55. The sign plate according to claim 50 wherein said second light reflecting layer is shaped and positioned whereby annular portions of said diffusion layer surrounding said second indicia are exposed by said second light reflecting layer.

56. The sign plate according to claim 50 wherein said first indicia are laterally offset with respect to said second indicia.

57. The sign plate of claim 50, wherein said second light reflecting layer comprises a fluorescent material.

58. The sign plate of claim 50, wherein said opening and said second light reflecting layer are physically arranged relative to one another so as to create an outline and an aura.

59. The sign plate of claim 50, wherein said light source comprises an electroluminescence light source.

60. A sign plate for an illuminated sign, the sign plate comprising a transparent light transmitting sheet, a first light reflecting layer on a rear face of said light transmitting sheet and having an opening therein defining a first indicia to be displayed by the sign and a second light reflecting layer defining a second indicia, corresponding to said first indicia, on a front face of said light transmitting sheet, wherein said opening and said second indicia are positioned such that when diffused light is directed through said opening and said transparent light transmitting sheet an aura around said first and said second indicia is formed;

an intermediate light reflecting layer located between said front light reflecting layer and said rear light reflecting layer, said intermediate light reflecting layer being shaped to define a second illuminated aura around said first and said second indicia;

wherein a width of said opening is greater than a width of said corresponding second indicia and wherein said opening and said second indicia are positioned such that when diffused light is directed through said transparent light transmitting sheet there is provided an illusion of an inclined edge of said first and said second indicia.

* * * * *